US005815889A

United States Patent [19]

Barth et al.

[11] Patent Number: 5,815,889

[45] Date of Patent: Oct. 6, 1998

[54] PROCESS AND DEVICE FOR REGULATING DRAFTING EQUIPMENT, IN PARTICULAR IN CARDING MACHINES

[75] Inventors: Gerhard Barth, Dittersdorf; Thomas Enghardt; Thomas Heinecke, both of Chemnitz; Gert Zeidler, Roehrsdorf, all of Germany

[73] Assignee: CSM-Saechsische Spinnereimaschinen GmbH, Chemnitz, Germany

[21] Appl. No.: 765,523

[22] PCT Filed: Jul. 10, 1995

[86] PCT No.: PCT/DE95/00882

§ 371 Date: Jan. 10, 1997

§ 102(e) Date: Jan. 10, 1997

[87] PCT Pub. No.: WO96/01917

PCT Pub. Date: Jan. 25, 1996

[30] Foreign Application Priority Data

Jul. 12, 1994 [DE] Germany ..... 44 24 091.0

[51] Int. Cl.[6] ..... D01H 5/32

[52] U.S. Cl. ..... 19/240; 19/236; 19/239

[58] Field of Search ..... 19/236, 239, 238, 19/240, 249, 250; 57/315, 317

[56] References Cited

U.S. PATENT DOCUMENTS

| | | | |
|---|---|---|---|
| 4,819,301 | 4/1989 | Konig et al. | 19/240 |
| 5,384,934 | 1/1995 | Dammig | 19/239 |
| 5,388,310 | 2/1995 | Haworth | 19/239 |
| 5,509,179 | 4/1996 | Mondini et al. | 19/239 |

FOREIGN PATENT DOCUMENTS

| | | | |
|---|---|---|---|
| 0553483 | 8/1993 | European Pat. Off. . | |
| 0617149 | 9/1994 | European Pat. Off. . | |
| 615181A1 | 9/1994 | European Pat. Off. . | |
| 3622584 | 1/1988 | Germany . | |
| 2415682 | 12/1992 | Germany . | |
| 4231527A1 | 3/1993 | Germany . | |
| 2081758 | 2/1982 | United Kingdom | 19/239 |
| 2133584 | 7/1984 | United Kingdom . | |

*Primary Examiner*—C. D. Crowder
*Assistant Examiner*—Larry D. Worrell, Jr.
*Attorney, Agent, or Firm*—Jordan and Hamburg

[57] ABSTRACT

A method of regulating a drafting arrangement, in which measuring signals are acquired at a feed end of the drafting arrangement, compared with a set value to provide a differential signal, and an adjusting signal for the control unit of a variable speed motor for the pair of drafting rollers is derived from the differential signal, provides reliable control results and adjustment of the sliver where a difference has been detected. Set values are entered by a transfer address from a set-point register. The basic speed is derived from actual speed of a doffer and supplied as basic voltage to the control unit of the variable speed motor. A measuring clock pulse of low frequency is generated, dependent upon a roller of the drafting arrangement. With every measuring clock pulse a measuring signal is obtained, converted into a digital signal, compared with the activated transfer address of the set-point register and a differential signal is generated. The differential signal obtained is transformed into a transfer address for a correction register, and that the control value read by the activated address in the correction register is supplied to the control unit of the variable speed motor. The invention also relates to a regulating device for carrying out the disclosed method.

10 Claims, 2 Drawing Sheets

PROCESS AND DEVICE FOR REGULATING DRAFTING EQUIPMENT, IN PARTICULAR IN CARDING MACHINES

BACKGROUND OF THE INVENTION

The invention relates to a method of regulating a drafting arrangement and, more particularly, to a method of regulating a drafting arrangement in which inconsistencies in thickness of a sliver are corrected during the drafting process. The invention also relates to a regulating device for carrying out the method.

Methods directed to achieving such regulation of a drafting arrangement have been addressed in the art, one such method described for example in German DE-OS 36 22 584. In accordance with the disclosed method, the thickness of the sliver is measured at the feed and delivery ends of the drafting arrangement. The measured values are evaluated with a time delay and, depending on the measured mass per unit of length and a set value for the mass per unit of length, are converted into an adjusting signal. From the difference between the measured mass and the preset value, a desired value is obtained by means of a first regulating circuit. This target value and a mass deviation evaluated with a time delay are used to generate, by means of a second regulating circuit, a correcting variable for setting the draft of the drafting arrangement.

This type of procedure has considerable disadvantages. For example, the draft may not always be reliably corrected exactly where the deviation from the set value has been detected within the sliver. Although the evaluation of the second measuring signal and the second control action reduces the probability of possible error thereby increasing likelihood of achieving an accurate, deviation-controlled drafted sliver as compared with a system with a single means for regulation, there still remains a chance of error.

In another regulating process described in German DE 42 02 352 A1, measuring devices are also arranged at the feed and delivery ends of the drafting arrangement and their measured values are compared with one another. The result is corrected by means of stored information and converted into an adjusting signal.

Such a regulator is relatively expensive, and the thickness of the sliver ascertained at the feed end of the drafting arrangement is not always corrected where necessary.

In this method it has been suggested that the time delay from the measuring point at the feed end of the drafting arrangement to the time of the output of the correcting command be represented as a variable of certain empirical values and other parameters. However, the results obtained in this way are still unsatisfactory insofar as random factors cannot be excluded (DE 42 15 682 and 42 02 352).

SUMMARY OF THE INVENTION

Accordingly, it is an object of the present invention to provide a method of regulating a drafting arrangement which overcomes the drawbacks of the prior art.

It is a further object of the present invention to provide a method of regulating a drafting arrangement in which the thickness of the sliver is reliably corrected in the place where the deviation has been detected.

It is still a further object of the invention to provide a device for carrying out the regulation method in a form which provides ease of operation and low maintenance, and which guarantees consistently good control results at any adjusted speed of the machine.

Briefly stated, the invention relates to a method of regulating a drafting arrangement, in which measuring signals are acquired at a feed end of the drafting arrangement, compared with a set value to provide a differential signal, and an adjusting signal for the control unit of a variable speed motor for the pair of drafting rollers is derived from the differential signal, provides reliable control results and adjustment of the sliver where a difference has been detected. Set values are entered by a transfer address from a set-point register. The basic speed is derived from actual speed of a doffer and supplied as basic voltage to the control unit of the variable speed motor. A measuring clock pulse of low frequency is generated, dependent upon a roller of the drafting arrangement. With every measuring clock pulse a measuring signal is obtained, converted into a digital signal, compared with the activated transfer address of the set-point register and a differential signal is generated. The differential signal obtained is transformed into a transfer address for a correction register, and that the control value read by the activated address in the correction register is supplied to the control unit of the variable speed motor.

According to the present invention, the above objectives are accomplished by a method in which a low-frequency measuring clock pulse is generated in response to and dependent upon rotation of a roller of the drafting arrangement. A measuring signal is acquired at the feed end of the drafting arrangement in response to the clock pulse and converted into a digital signal. The set values are entered by a transfer address from a set-point register. The digital signals are compared with a set value in the activated transfer address of the set-point register and a differential signal is generated. The determined differential signal is transformed into a transfer address for a correction register. Then, a control value is read by the activated address in the correction register and an adjusting signal is derived for the control unit of the variable speed motor for the pair of drafting rollers based upon the differential signal. The adjusting signal is then supplied to the control unit of the variable speed motor.

Since the set value is permanently available in the form of a set-point address from a set-point register and a signal for the basic speed of the motor to be regulated, the processing of a measuring signal limited merely to its conversion into a digital signal and the transformation into a transfer address while processing the set value.

The command adjusted by the transfer address for correcting the driving voltage of the variable speed motor remains unchanged in its condition until the next correction value is obtained, and it can feed the set correction value into the variable speed motor over extended periods of time. The variable speed motor has sufficient time to correct its magnetic fields and to accelerate and decelerate the mechanical elements, rotor and drawing-in rollers to the new speed value. At the end of the acceleration, at usual sliver speeds and in usual dimensions of the drafting arrangement, the sliver sections, which have predetermined the value of the measuring signal, are within the sphere of action of the pair of drafting rollers. It has turned out that very good control results can also be obtained at higher sliver speeds, for example, as high as 250 m/min.

The present invention further provides an embodiment of the method which guarantees that, with simple and low-cost components, the set values can be made available for long periods of time and easily adapted to new conditions. The embodiment includes conversion of the analogue preset value into a digital signal by an A-D converter, and transformation of the digital signal into a transfer address for the set-point register.

According to a feature of the invention, there is further provided a method in which the measuring clock pulse is obtained by a sensor which thereby allows a compact design of the controller without interfering with other devices of the machine.

The present invention further includes a feature in which the control value provided for the basic speeds of the variable speed motor is obtained as a digital speed pulse, and converted into a voltage signal by an electronic processing unit. The voltage signal then supplied to the control unit for the variable speed motor, and has the advantage that the synchronism between doffer and drafting arrangement is guaranteed under all conditions.

In accordance with a further feature of the invention, in the event of a power failure, the synchronism can be maintained by the use of appropriate energy stores for the information transmission and for the control of the variable speed motor.

Yet a further embodiment of the invention directed to a device for practicing the above method, guarantees a high quality of the control results with simple, currently available components.

In accordance with a feature of the invention directed to the above device a pair of measuring rollers is provided, of which at least one roller revolves in connection with the pair of drawing-in rollers. Further, the driving connection between neighboring pairs of rollers customary for can coilers can be used as a structural component.

In a further embodiment, one of the drawing-in rollers has at least four generator marks, staggered to one another by almost the same angular intervals, to which a fixed sensor is allocated. The measuring rollers are arranged to the drawing-in rollers, and the drawing-in rollers are arranged to the drafting rollers along the travelling direction of the silver and staggered by about 50 mm each. These angles and spacings result in the fact that, at the usual sliver speeds, the sliver draft is corrected where the difference has been detected.

A further feature of the invention provides a device in which a can coiler for sliver coiling following the drafting arrangement is driven by a motor, which is indirectly powered in a manner dependent upon the speed of the variable speed motor of the drafting arrangement, such that no separate regulating device need be provided for the motor to drive the can coiler. A sliver storage between drafting arrangement and can coiler can thus be avoided.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
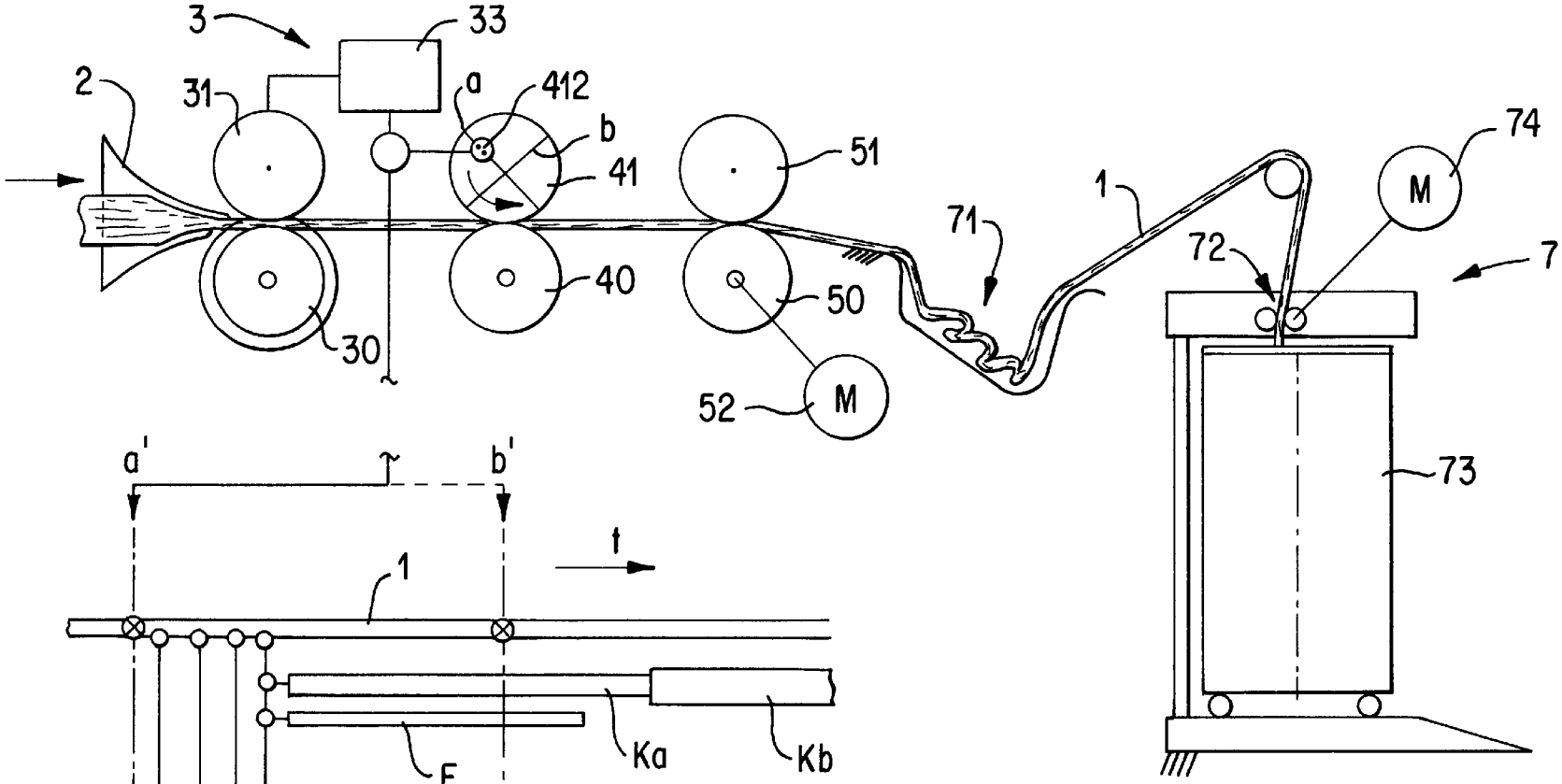
FIG. 1 is a schematic representation of the working elements of the regulated drafting arrangement in connection with a so-called can coiler.

Referring to FIG. 1, a drafting arrangement is located at the delivery end of a flat card and arranged, in the generally known manner, behind sliver funnel 2. Directly behind funnel 2 and instead of the usual pair of calender rollers, a pair of measuring rollers 30,31 is arranged, which is a component part of a data transmitter 3. The bottom measuring roller 30 is stationary and subject to rotary drive. The top measuring roller 31 runs on bearings, and is vertically movable and loaded. A measuring transducer 33 scans the vertical position of the top roller 31 and transforms a displacement signal generated thereby into an analogue electric quantity. In this way, it supplies a signal which is proportional to the thickness of a sliver 1 passing between rollers 30,31.

The pair of measuring rollers 30,31 is followed by the pair of drawing-in rollers 40,41 at a distance of about 50 mm. The bottom roller 40 is also stationary and driven in a certain transmission ratio to a doffer 631 (shown in FIG. 2). The top roller 41 is nonpositively held at the bottom roller 40. It rotates with the latter and squeezes sliver 1 passing through. One of the pair of measuring rollers 40,41 has a number of generator marks 411 at almost uniform angular distances, which are scanned by a fixed sensor 412. The pulses obtained in this way are converted into electric clock signals, the measuring clock pulses a, b, . . . .

At another distance of about 50 mm, or any other distance depending on the mean staple length of sliver 1, a pair of drafting rollers 50,51 is arranged. Each of the rollers of the pair of drafting rollers 50,51 are identical with those of the pair of drawing-in rollers 40,41. The bottom roller 51 is driven by a variable speed motor 52, which is a servomotor. A processing unit 6 for the draft quantities and a control unit 53 are allocated to variable speed motor 52.

Having passed the pair of drafting rollers 50,51, sliver 1 reaches the area of the so-called can coiler 7, either directly or indirectly via an intermediate storage 71, and is then conveyed through a pair of coiling rollers 72 according to a given scheme, and coiled in a sliver can 73. The pair of coiling rollers 72 of can coiler 7 is driven by a separate motor 74 in a known manner. The speed of motor 74 is regulated or controlled, respectively, in dependence on the delivery speed of the drafting arrangement.

Figure 2:
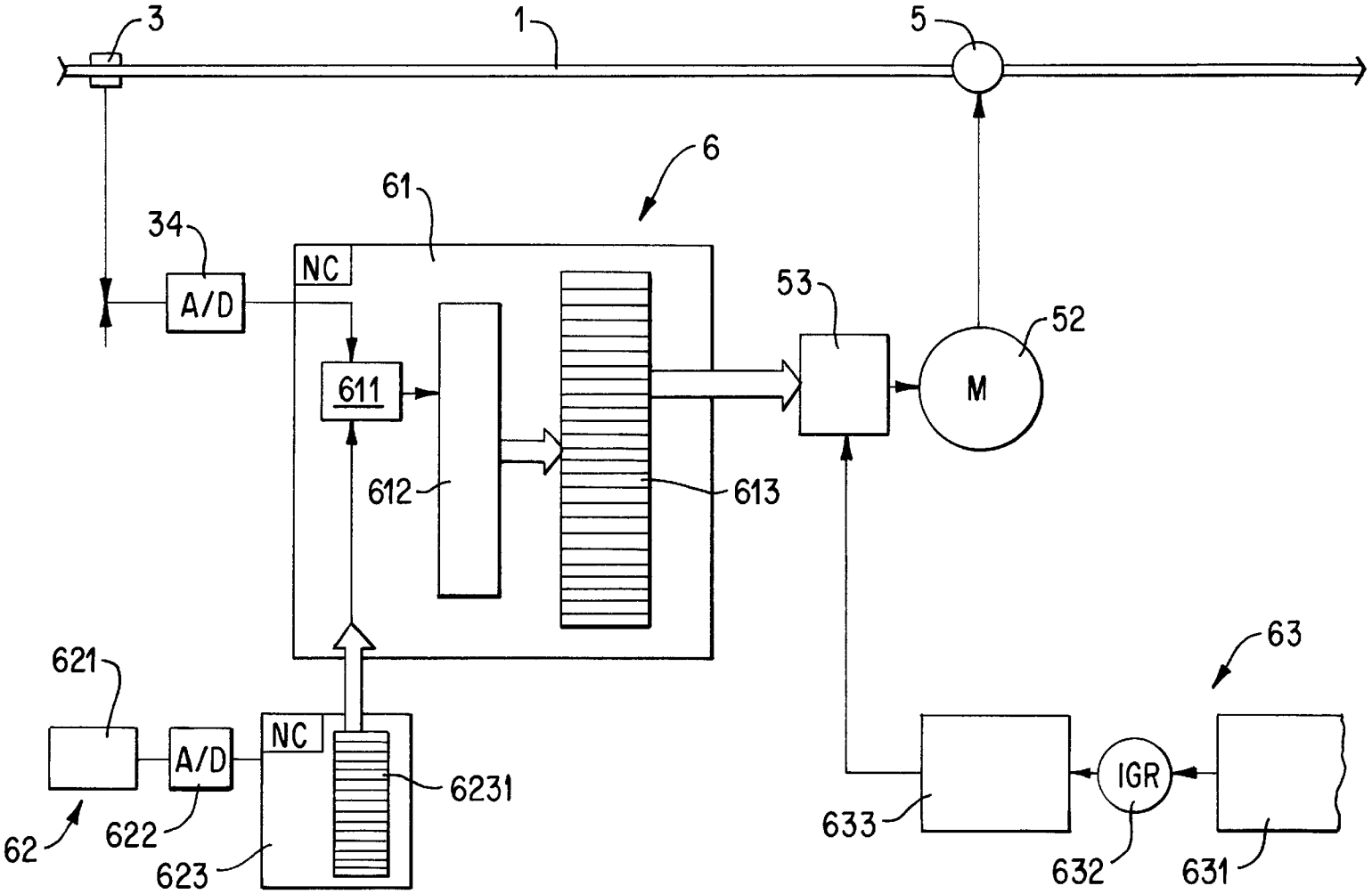
FIG. 2 is a block diagram of the regulating device for the drafting arrangement.

Turning now to FIG. 2, the mode of operation of the regulated drafting arrangement shall be described with reference thereto. As mentioned above, FIG. 2 shows a block diagram of a regulating circuit for variable speed motor 52 of the pair of drafting rollers 50,51. Data transmitter 3 supplies an analogue value of the thickness of sliver 1 directly behind funnel 2. The analogue signal is fed into an A-D converter 34, which digitizes the analogue signals in an 8-bit form. A-D converter 34 is followed by a numerical control system 61, whose tasks and component parts will be described below.

Parallel to this transmission of data, an analogue set value is first entered at a set-point input 621. This set value operating as a reference input is digitized by means of an A-D converter 622 and transformed into a transfer address by another numerical control system 623. The transfer address is used for selecting one of the stored set values from a set-point register 6231 and for transferring it to numerical control system 61 for data transmitter 3.

The set value prepared in this manner is compared with the digitized measured value. Transfer addresses are next defined from the differential signal obtained, depending on the value of the difference. Using the transfer addresses from the differential value, a command line is selected from a correction register 613 whose activated information is then supplied to control unit 53 for variable speed motor 52.

In addition, control unit 53 is supplied with a control voltage, which is proportional to the speed of the card's doffer 631. The speed signal is generated by means of an incremental transducer (IGR) 632, whose pulse train is evaluated by a transducer card 633 and transformed into an equivalent voltage. In control unit 53, the voltage value for the correction and the voltage value for the basic speed are added, and an appropriate control command is transmitted to variable speed motor 52.

Variable speed motor 52 is a highly dynamic servomotor, the rotor thereof having an extremely low moment of inertia. According to the selection series, it has a moment of inertia of less than 0.001 $kpm^2$. Motor 52 should have a moment of inertia that is big enough for performing the necessary corrections of the speeds for the pair of drafting rollers 50,51 in an adequately short period of time.

Figure 3:
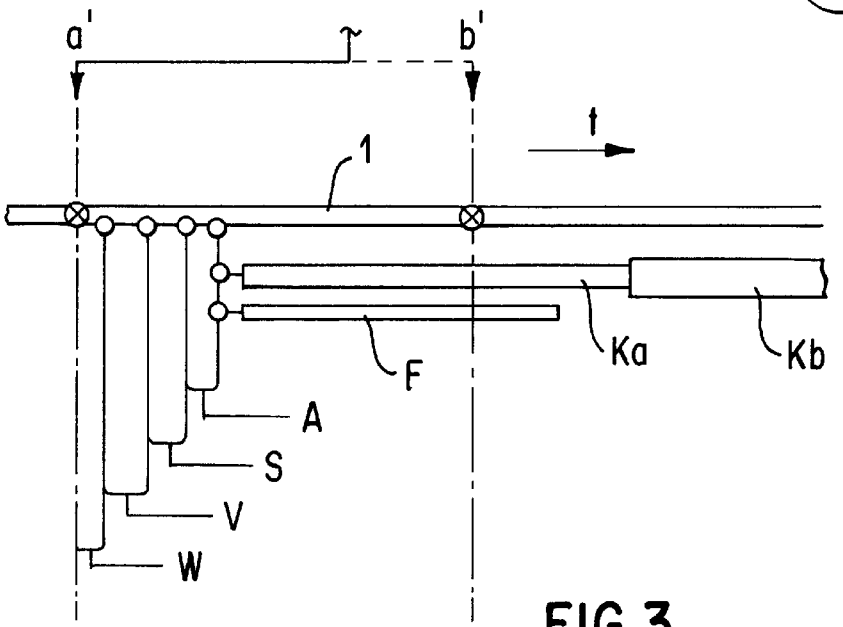
FIG. 3 is a schematic representation of the regulating action along a time axis.

Referring now to FIG. 3, another schematic representation of the regulating action along a time axis t is depicted. The time values illustrated are not shown accurately proportional to actual values. The depicted representation has been chosen in order to demonstrate how the individual operations are carried out, in sequence within very short periods of time, in a manner which guarantees, as exactly as possible, accurate drafting at the point of sliver 1 where the difference has been detected.

For the first procedure step, i.e. the conversion of the measured value of the sliver thickness, the A-D converter requires a mean value of about 0.8 ms, indicated by an A-D conversion time period W which is initiated by an initial clock pulse a'. Another 5 to 6 ms are required for the comparison of the measured value and the set value in the comparator 611 indicated as a comparison time period V, the definition of the transfer address at 612 for correction register 613 indicated as a definition time period S, as well as the selection of the transfer address from correction register 613 indicated as a time period A. The control unit 53 also needs about the same time for outputting the correcting variable for the variable speed motor 52.

Variable speed motor 52 again requires some time for the necessary speed correction, which is considerably longer than the time needed for processing the electric quantities. Only when a perceptible speed variation occurs, is correction of the sliver thickness by increasing or reducing the draft accomplished.

It must also be taken into consideration that the fibres, which must be displaced within sliver 1, are not always, as required, in such a frictional connection with the rollers that guarantees their correct draft. The desired value from the set-point register 6231 is available for an unlimited period of time.

The digital output of the measured value by A-D converter 34 allows the comparison and the definition of the transfer address at the same time. If the transfer address is switched through in correction register 613, A-D converter 34 also receives a signal, which allows the switching through of the next measured value in the next measuring clock pulse b'.

Upon arrival of the next measuring pulse b', the next measured value is entered into the control system and processed in the same manner as described above with regard to the first pulse a'. As soon as the new current address is activated in correction register 613, control unit 53 corrects its output and causes variable speed motor 52 to run at the new corrected speed.

At an assumed mean sliver speed of about 170 m/min, the measured point of sliver 1 is moved up to the pair of drawing-in rollers 40,41 in about 17 ms. The sliver needs another 17 ms to reach the pair of drafting rollers 50,51. With a drafting roller diameter of about 30 mm and four generator marks 411 on one of the pair of drawing-in rollers 40,41, a time interval of about eight to ten milliseconds will be required from one pulse to the next.

Since no calculating operations are required for determining the set value, each new correction value can be provided for variable speed motor 52 within a very short time. Variable speed motor 52 can start to vary its speed directly after the measuring operation and, as soon as the next correction value arrives, either finish or continue the correction. Apart from the natural tolerances, the correction can be carried out at the time when the measuring point on the sliver 1 is moving within the range of action of drafting rollers 50,51.

It must also be taken into account that, due to the mean fibre length, the draft range of drafting rollers 50,51 extends almost up to the nip between drawing-in rollers 40,41. The measured point on sliver 1 has reached that area when the motor speed has already changed by a sufficient value.

An adequate period of time elapses before the next correction signal arrives, allowing sufficient time for the motor to complete the correction according to the values set by the correction register. The time period ends when variable speed motor 52 has already undergone a perceptible speed variation based on the new correction signal.

If it turns out that the correction values are too big or too small, a variation can be achieved by modifying the allocation to the command lines of the correction register, i.e. the address designations.

Triggering of new measuring pulses when the previous control operation is not yet completed should be avoided, particularly a high operating speeds. For this purpose, a pulse F is transmitted with the correction address to A-D converter 34 of data transmitter 3, which releases the transmission of a new measured value to the numerical control system 61. This means that no new measured value can be transmitted until the previous processing operation for the adjusting signal is completed.

Tests have shown that the control performance for the sliver thickness is very good at the usual sliver speeds of 170 m/min. Surprisingly, almost ideal control results are achieved at higher speeds (up to 250 m/min). The control results obtained at very low speeds, for example, at the creep speed, are also good because the end of every control operation is limited by achieving the new speed. The recovery time of an operation has no effect on the correction value.

The unique aspects of the invention are achieved by virtue of the fact that the time for the provision of a correction value effective in practice can be kept very short, and motor 52 has sufficient time for reaching the corrected speed before the measured section of sliver 1 enters the range of action of drafting rollers 50,51.

In the present example, the supply of transfer addresses and the selection of registers are achieved by means of prepared adjusting instructions. It is also possible to use very fast computers to supply the data to be evaluated, and to maintain the supply over a given angular range of the drafting rollers.

It is further noted, that owing to the differing outgoing speeds of sliver 1 at the end of the drafting arrangement, it is also necessary to drive the pair of coiling rollers 72 of can coiler 7 at a matched speed. For this purpose, according to convention, an additional regulation can be allocated to motor 74 arranged there. It is easier, however, to correct the speed of motor 74 together with variable speed motor 52. A low-cost configuration is provided if both motors 74 and 52 are allocated to a single control unit, or if an incremental transducer, whose speed signals directly determine the speed of motor 74, is allocated to variable speed motor 52.

What we claim is:

1. A method of regulating a drafting arrangement, comprising the steps of:

providing a pair of drafting rollers driven by a variable speed motor, a basic speed of which is derived from an actual speed of a doffer in a preceding operation and determined by a basic voltage supplied to a control unit of the variable speed motor;

generating a low-frequency measuring clock pulse in response to and dependent upon rotation of a roller of the drafting arrangement;

entering set values by a transfer address of a set-point register;

acquiring a measuring signal at a feed end of the drafting arrangement in response to said clock pulse;

converting said measuring signal into a digital signal;

comparing said digital signal with a one of said set values of the transfer address of said set-point register to obtain a differential signal;

transforming said differential signal into a transfer address for a correction register;

reading a control value of the transfer address of the correction register;

deriving an adjusting signal for the control unit of the variable speed motor for the pair of drafting rollers based upon said control value; and supplying said adjusting signal to the control unit of the variable speed motor.

2. A method according to claim 1, wherein:

each of said set values are converted into a digital signal by an A-D converter; and said digital signal is transformed into said transfer address for said set-point register.

3. A method according to claim 1 or 2 wherein:

the drafting arrangement includes a drawing-in roller including at least one generating mark formed thereon, said measuring clock pulse being obtained by a sensor which detects said at least one generating mark.

4. A method according to claim 1 or 2 further including the steps of:

obtaining a digital speed pulse from the doffer;

converting said digital speed pulse into a voltage signal by an electronic processing unit; and supplying said voltage signal to said control unit for said variable speed motor.

5. A regulating device for a drafting arrangement, comprising:

a pair of drawing-in rollers;

a pair of drafting rollers rotatably driven by a variable speed motor;

a microprocessor-based control unit including means for adjusting a speed of said variable speed motor;

said variable speed motor being a controllable servomotor including a controller with a cycle time, said cycle time being smaller than 15 ms, and including a rotor having a moment of inertia that is smaller than 0.001 $kpm^2$;

a measuring device in front of said pair of drawing-in rollers including means for measuring a thickness of a sliver at a location therealong, said measuring device further including a data transmitter;

said drawing-in rollers being driven at a speed dependent upon that of a doffer of a preceding operation;

said drawing-in rollers including at least one generator mark formed thereon for producing a clock pulse in response to rotation of said drawing-in rollers;

a frame-fixed sensor including means for sensing said at least one generator mark and for generating a measuring clock pulse in response to a sensing thereof, said sensor being electrically connected with said data transmitter of said measuring device;

said measuring device being followed by an A-D converter and a processing unit including a transfer address definition and a correction register.

6. A regulating device according to claim 5, wherein said measuring device includes a pair of measuring rollers, at least one of which revolves in connection with said pair of drawing-in rollers.

7. A regulating device according to claim 5 or 6, wherein a basic draft of the drafting arrangement corresponds to a ratio of about 1:1.3.

8. A regulating device according to claim 5 or 6, wherein a draft between said pair of measuring rollers and said pair of drawing-in rollers corresponds to a ratio of about 1:1.05.

9. A regulating device according to claim 5 or 6, wherein:

a one of said drawing-in rollers includes at least four generator marks staggered to one another by approximately same angular intervals, to which said fixed-frame sensor is allocated; and said measuring rollers are arranged to said drawing-in rollers, and said drawing-in rollers are arranged to said drafting rollers along a travelling direction of the sliver and staggered by about 50 mm each.

10. A regulating device according to claim 5 or 9, further comprising:

a can coiler including means for sliver coiling following the drafting arrangement, said can coiler being driven by a motor which is indirectly powered and dependent upon a speed of said variable speed motor.

* * * * *